United States Patent [19]

Kelley et al.

[11] Patent Number: 4,911,586

[45] Date of Patent: Mar. 27, 1990

[54] PLUG FOR PIER HOLE

[75] Inventors: Mark R. Kelley, P.O. Box 131, El Granada, Calif. 94018; Ronald P. Mackwood, Hayward, Calif.; John M. Broderick, San Mateo, both of Calif.

[73] Assignee: Mark R. Kelley, El Granada, Calif.

[21] Appl. No.: 298,427

[22] Filed: Jan. 18, 1989

[51] Int. Cl.[4] ..... E02D 5/00

[52] U.S. Cl. ..... 405/303; 405/133; 405/150; 405/232

[58] Field of Search ..... 405/150, 131, 303, 231, 405/232, 233; 166/187, 387; 138/93; 273/58 R, 58 J

[56] References Cited

U.S. PATENT DOCUMENTS

| | | | |
|---|---|---|---|
| 3,276,481 | 10/1966 | McNulty | 138/93 |
| 3,427,022 | 2/1969 | Ward | 273/58 R X |
| 3,459,230 | 8/1969 | Smith | 138/93 |
| 3,520,534 | 7/1970 | Bennett et al. | 273/58 R |
| 4,029,128 | 6/1977 | Yamagishi | 138/93 X |
| 4,160,464 | 7/1979 | Ballinger | 138/93 |
| 4,377,184 | 3/1983 | Vetter | 138/89 |
| 4,398,565 | 8/1983 | Williamson | 138/93 |
| 4,492,095 | 1/1985 | Brister | 138/93 X |
| 4,506,706 | 3/1985 | Sandmann | 138/93 |
| 4,518,015 | 5/1985 | Fischer | 138/93 |
| 4,609,042 | 9/1986 | Broadus et al. | 166/187 |
| 4,612,961 | 9/1986 | Vetter | 138/93 |
| 4,614,206 | 9/1986 | Mathison et al. | 138/93 |
| 4,660,644 | 4/1987 | Egnor | 166/285 |
| 4,671,518 | 6/1987 | Retz | 138/93 X |

FOREIGN PATENT DOCUMENTS

| | | | |
|---|---|---|---|
| 256105 | 1/1965 | Australia | 166/187 |
| 854297 | 11/1952 | Fed. Rep. of Germany | 138/93 |
| 2815663 | 10/1978 | Fed. Rep. of Germany | 405/272 |
| 2082655 | 11/1971 | France | 273/58 BA |

*Primary Examiner*—Dennis L. Taylor
*Attorney, Agent, or Firm*—T. R. Zegree

[57] ABSTRACT

An inflatable, stretchable plug for obstructing a hole drilled in the ground for a foundation pier comprises a sturdy elastic envelope having an air valve mounted in the wall thereof for connection with outside supply of pressurized air and a handle bonded to upper portion of the envelope for easy removal of the plug from the hole before concrete mixture is poured in to produce the pier.

13 Claims, 1 Drawing Sheet

PLUG FOR PIER HOLE

BACKGROUND OF THE INVENTION

This invention pertains to a plug for a pier hole. More particularly, this invention relates to an inflatable plugging device for use in obstructing a hole drilled in the soil to be filled with concrete in the process of forming a pier.

Various types of expansible devices for plugging pipes, pipelines, tubes, well casings or other hollow conduits have been described in the patent literature. For example, U.S. Pat. Nos. 4,160,464 to Ballinger; 4,377,184 to Vetter; 4,398,565 to Williamson; 4,506,706 to Sandmann; 4,609,042 to Broadus; 4,612,961 to Vetter; and 4,614,206 to Mathison et al disclose different structures of such devices. In addition, U.S. Pat. No. 4,029,128 to Yamagishi decloses an air bag for plugging the hollow of a concrete pile driven into the ground with concrete material to be placed on top of the bag; and U.S. Pat. No. 4,660,644 to Egnor describes an elongated inflatable device having two spherically shaped ends with a recess therebetween for use in closing a blasting hole.

While the above-mentioned patents disclose the general concept of air-inflatable plugging devices designed for a variety of uses, the present invention provides a new approach for a structural form of an inflatable plug developed especially for use in conjunction with empty pier holes drilled in the soil which offers certain advantages over the prior art devices.

With a marked increase in the number of new residential homes, apartment complexes, condominiums and commercial buildings under construction on various types of soil, it has become increasingly desirable or frequently required, especially in earthquake-prone areas, to install a number of spaced apart concrete piers in vertically oriented holes drilled in the ground of the construction site in order to reinforce the foundation of the structure to be built thereon, to stabilize the soil and to level the ground when the need arises. Although the depth of pier holes is usually in the range of from 6 to 30 feet, it may vary broadly between about 2 and 50 feet depending on the character of the house or the building. Likewise, the diameter of such holes may vary between about 6 and 60 inches, although usually between 12 and 36 inches. As it is highly important that the interior of drilled holes remains uncontaminated by foreign materials which may fall therein before a concrete mixture is poured in, the holes are frequently covered with plywood sheets to prevent entry of such undesirable materials therein. However, such practice has been found not very satisfactory, as plywood covers may inadvertendly be displaced so as to expose a portion or the entire opening of the hole. Moreover, a partially or entirely open pier holes on a building site presents a potential danger of accidental fall of a person or an animal therein. Thus the present invention overcomes the disadvantages of the current practice of covering pier holes with plywood sheets.

OBJECTS OF THE INVENTION

In view of the foregoing, it is the principal object of the present invention to provide an improved, durable, air-inflatable plug specifically adapted for closing temporarily a foundation pier hole prior to pouring a concrete mixture therein.

It is another object of the invention to provide a sturdy, stretchable plugging device of a simple novel structural design for use in obstructing effectively a hole drilled in the ground for filling with concrete in the formation of a pier used in strengthening a foundation for a house or a building.

Still another object of the invention is the provision of an adjustable and flexible air-inflatable plug of the character described herein which is serviceable under any outdoor weather conditions and which can be manufactured at a low cost from readily available materials.

These and other objects of the invention will become more fully apparent from the following description when considered in conjunction with the accompanying drawing.

BRIEF SUMMARY OF THE INVENTION

In accordance with the invention described in its preferred embodiment, there is provided an inflatable, stretchable plug for obstructing a pier hole in the soil comprising, in combination: a hollow, expandable envelope having a generally spherical shpae in inflated state; an air valve means fixedly mounted on said envelope for connection of a source of air with the interior of said envelope; means for closing and opening said air valve means; and a handle secured to upper portion of said envelope for easy removal of said plug from said pier hole.

BRIEF DESCRIPTION OF THE DRAWING

In the accompanying drawing wherein like reference characters designate corresponding elements throughout the views thereof.

DETAILED DESCRIPTION OF THE INVENTION

Figure 1:
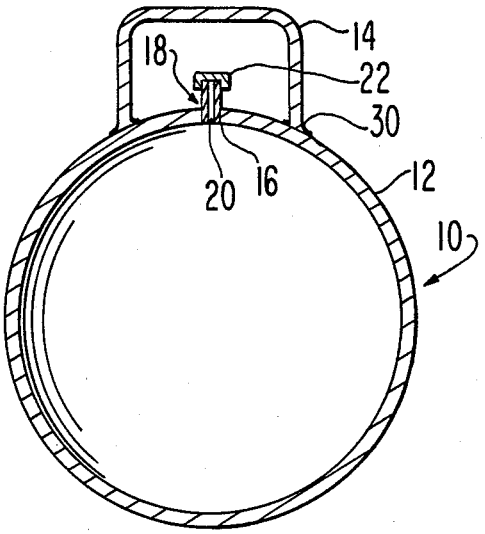
FIG. 1 is a sectional elevation view of the plug according to the invention in its inflated state.
Figure 4:
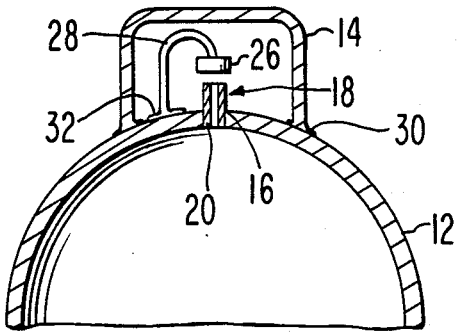
FIG. 4 is a cross-sectional view of the upper portion of the plug with a portion thereof broken away showing still another form of the invention.

Referring now to the drawing, an elastic stretchable and durable air-inflatable plug 10 for a vertically drilled pier hole 24 is illustrated in FIG. 1 in its inflated condition. Plug 10 comprises a hollow envelope 12 having smooth outer and inner walls which is foldable to a substantially flat, non-inflated form and which is inflatable by air under pressure to a generally spherical shape. In order to fill envelope 12 with air, a conventional air valve means 18 is fixedly mounted in the upper portion thereof through a small opening 16 in the wall of the envelope so as to form an airtight seal therewith. A suitable air-lock valve includes a somewhat rigid but flexible cylindrical stem 20 which may have externally threaded upper portion, an air release mechanism inserted therein and having an inner conduit throughout its length for passage of air therethrough into the interior of envelope 12, the free end of stem 20 extending upwardly from the wall of envelope 12 to a readily accessible position for connection with a suitable means for supply of air, such as a piston-type manual pump used for inflating bicycle innertubes, a compressor or the like. Air valve means 18 also includes a suitable closing and opening means, such as a conventional internally threaded screw cap 22 or a snugly fitted removable snap fastener 26 connected to a flexible link 28 having an attachment flange 32 sealingly bonded to the outer wall of envelope 12, as illustrated in FIG. 4. It is to be noted that the closing and opening means provides an airtight contact with the air valve so that any escape of air form the interior of the envelope is prevented. Air valve means 18 is secured sealingly to the wall of envelope 12 by any conventional bonding method, such as vulcanization, as employed for example in securing an air valve to an innertube of a bicycle tire.

An important feature of this invention is provision of a handle 14 which is secured to the upper portion of envelope 12 and adapted primarily for easy removal of plug 10 in a partly or completely deflated from a solid but somewhat elastic rubberlike or plastic material and is sealingly bonded to the outer surface of envelope 12 by any conventional method employed in bonding rubbery materials to each other, such as by vulcanization. As shown in FIGS. 1 –4, handle 14 may be of a generally arcuate configuration having at each end thereof an elastomeric flange 30 secured thereto around its perimeter to produce a permanent bond between such flange and the adjoining surface of envelope 12.

Figure 3:
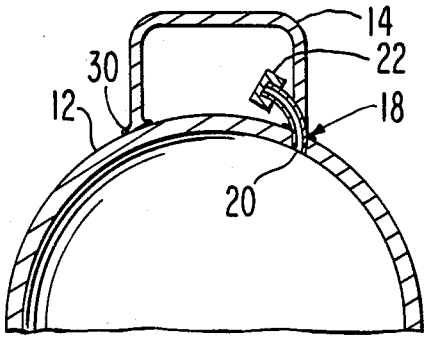
FIG. 3 is a cross-sectional view of the upper portion of the plug, a portion of which being broken away, showing another form of the invention.

In order to protect air valve means 18 from possible accidental damage, the exposed portion of stem 20 is preferably disposed underneath handle 14. Thus air valve means 18 may be mounted on the central portion of envelope 12, as shown inFIGS. 1, 2 and 4 or a portion of stem 20 may be inserted into a channel especially provided in the lower portion of handle 14 adjacent envelope 12, as shown in FIG. 3, so that air inlet is located under handle 14, whereas air oulet is disposed in the opening in the wall of envelope 12 for admission of air in the interior thereof.

Handle 14 is dimensioned for convenient insertion of user's hand in the space between the handle and the envelope so that the pier hole plug may be pulled out from pier hole 24 when it is no longer needed for obstruction thereof prior to filling it with a fluid concrete mixture which is subsequently allowed to harden until a solid concrete pier is formed in the hole.

Whie the envelope according to the invention is preferably constructed from a single sheet of a sturdy, elastic, waterproof, puncture-resistant, heavy gauge elastomeric material, such as polyisoprene, butadieneacrylonitrile or other known polymers, having substantially uniform thickness and density, other rubbery or plastic sheet materials having similar properties are likewise suitable for the manufacture of the envelope.

The plug of the invention may be produced in any size suitable to fit its contemplated use. Although the diameter of the inflated plug may vary to certain extent depending on the diameter of the pier hole, it is important that the envelope be adjustably stretchable when inflated with air to a substantailly airtight sealing engagement with the adjacent wall area of the hole drilled in the ground for preparation of a concrete pier.

Figure 2:
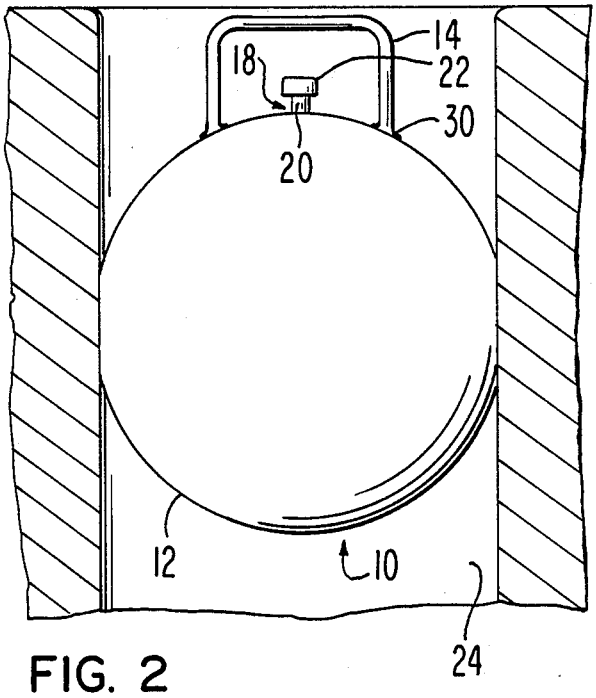
FIG. 2 is a sectional elevation view of a drilled pier hole with the inflated plug placed therein in operable position.

The plug can be positioned in a pier hole in operative manner by placing it inside the drilled hole near the ground level in its non-inflated or partially inflated state with the air valve projecting upwardly and filling it with air by means of the air valve connected to a suitable source of pressurized air until the envelope is sufficiently expanded to form an airtight contact with the inner wall of the pier hole. As shown in FIG. 2, the plug is preferably disposed in its inflated state adjacent the top portion of the pier hole so that the uppermost edge of the handle is positioned somewhat below the ground level to facilitate its withdrawal by hand from the hole and to permit grading equipment to pass thereover without interference with the handle. After disconnecting the air valve from the air source and closing it with a screw cap or another closing means, the fully inflated plug remains in the hole as long as necessary for blocking introduction of any foreign material, then it may be part or completely deflated by opening the air valve and removed readily from the hole for possible reuse or storage.

It will be apparent from the foregoing description that we have devised a novel reusable plug specially adapted for use in the commercial or residential building industry for safely obstructing pier holes drilled in the ground to prevent contamination thereof with undesirable foreign materials and to minimize or prevent introduction of rain water or snow into the bottom of the hole. The plug is characterized by a new combination of structural elements including an inflatable resilient envelope equipped with a pneumatic valve and a handle secured to the upper portion thereof above the air valve. The specific arrangement of the handled permits an easy insertion and removal of the plug from a pier hole and protects the air valve from inadvertent damage. Due to stretchable property of the envelope, the size of the inflated plug may be adjusted to a desired operative position in the hole as long as a sealing contact between the outer wall of the envelope and the inner wall of the pier hole in engagement therewith is established and maintained, thereby preventing entry of any undesirable material into the hole. Such novel combination of features of the invention renders it highly suitable for use and reuse on construction sites for blocking drilled holes before a concrete mixture is poured therein. Due to simplicity of its design from a single sheet of a durable elastomeric material combined with an air valve protected by a handle firmly bonded thereto, the plug may be manufactured inexpensively in a large volume.

It will be understood that various modifications in the form or in the constructional details of our invention as herein described may be made without departing from the spirit thereof or the scope of the claims which follow.

We claim:

1. An inflatable plug for use on construction sites in obstructing temporarily a foundation pier hole drilled in the ground prior to pouring concrete in said hole and adapted for placement a short distance below ground level, said plug comprising in combination with said hole:

a completely hollow, flexible envelope formed from stretchable heavy gauge elastomeric material forming a tight seal, when inflated, with an inner wall of said hole;

an air valve means fixedly mounted on upper portion of said envelope for inflating and deflating said plug with air;

a means for closing and opening said valve means; and a handle secured to the upper portion of said envelope for easy removal by hand of said plug in deflated state from said hole, said handle being positioned so that said valve means in disposed underneath said handle for protection of said valve means from accidental damage.

2. A plug of claim 1 wherein said elastomeric material comprises rubber or rubberlike material.

3. A plug of claim 1 wherein said air valve means is mounted through an opening in said envelope so as to form an airtight seal therewith.

4. A plug of claim 1 wherein upper portion of said air valve means comprises a flexible stem having a conduit for air passage therethrough, the free end of said air valve means extending upwardly from said envelope.

5. A plug of claim 1 wherein said air valve means comprises a closing means for preventing escape of air from interior of said envelope in inflated state.

6. A plug of claim 1 wherein said air valve means comprises a flexible link having an attachment flange adapted for bonding said link to said envelope.

7. A plug of claim 1 wherein exposed portion of said air valve means is disposed underneath said handle for protection from accidental damage.

8. A plug of claim 1 wherein portion of said air valve means extends through an opening in said handle adjacent the wall of said envelope.

9. A plug of claim 1 wherein said handle is dimensioned for easy insertion of a hand in the space between said handle and said envelope.

10. A plug of claim 1 wherein said handle is formed from a solid rubberlike material.

11. A plug of claim 1 wherein said handle is secured to said envelope by a sealing bond.

12. A plug of claim 1 wherein said envelope is extendible when inflated with air to a substantially airtight sealing engagement with upper portion of said pier hole.

13. A plug of claim 1 adapted for temporary obstruction of a pier hole wherein said plug is disposed in inflated state in said pier hole adjacent top portion thereof, whereby uppermost edge of said handle is positioned slightly below ground level.

* * * * *

UNITED STATES PATENT AND TRADEMARK OFFICE

CERTIFICATE OF CORRECTION

PATENT NO. : 4,911,586

DATED : March 27, 1990

INVENTOR(S) : Kelley et al

It is certified that error appears in the above-identified patent and that said Letters Patent is hereby corrected as shown below:

Co. 2, line 22, "shape" is misspelled;

Col. 3, lines 17 and 18 should read --...deflated condition from pier hole 24 when desired. Handle 14 may be fabricated from a solid...--;

line 31, "in" and "FIG" should be separated;

line 45, "while " is misspelled;

Col 4, line 15, "specially" should read --specifically--;

line 26, "handle" is misspelled.

Signed and Sealed this

Fifth Day of March, 1991

*Attest:*

*Attesting Officer*

HARRY F. MANBECK, JR.

*Commissioner of Patents and Trademarks*